US008796567B2

(12) United States Patent
Mahle et al.

(10) Patent No.: US 8,796,567 B2
(45) Date of Patent: Aug. 5, 2014

(54) SWITCH CONVERSION APPARATUS

(75) Inventors: Michael S. Mahle, Fairport, NY (US); Mark Patrick Rau, Walworth, NY (US); Craig F. Hoffman, Fairport, NY (US); Craig Person, Fairport, NY (US); John F. Kasper, Farmington, NY (US); Daniel John Bentley, Rochester, NY (US); Scott D. Reiner, Bergen, NY (US); Christopher John Lundgren, Fairport, NY (US)

(73) Assignee: Michael Mahle, Fairport, NY (US)

( * ) Notice: Subject to any disclaimer, the term of this patent is extended or adjusted under 35 U.S.C. 154(b) by 669 days.

(21) Appl. No.: 12/903,616

(22) Filed: Oct. 13, 2010

(65) Prior Publication Data

US 2011/0083948 A1 Apr. 14, 2011

Related U.S. Application Data

(60) Provisional application No. 61/251,094, filed on Oct. 13, 2009, provisional application No. 61/318,997, filed on Mar. 30, 2010.

(51) Int. Cl.

| | |
|---|---|
| ***G04F 1/00*** | (2006.01) |
| ***G04F 3/02*** | (2006.01) |
| ***G04F 3/06*** | (2006.01) |

(52) U.S. Cl.
USPC ..... 200/33 R; 200/34; 200/331

(58) Field of Classification Search
USPC ..... 200/34, 33 R, 330, 331, 337, 338
See application file for complete search history.

(56) References Cited

U.S. PATENT DOCUMENTS

| | | | | |
|---|---|---|---|---|
| 1,922,868 | A | | 8/1933 | Rucker |
| 1,989,393 | A | | 1/1935 | Anderson |
| 2,035,648 | A | * | 3/1936 | Frank ..... 200/34 |
| 2,172,731 | A | | 9/1939 | Coles |
| 2,637,788 | A | * | 5/1953 | Bracken ..... 200/34 |
| 2,937,247 | A | | 5/1960 | Laviana et al. |
| 3,177,975 | A | | 4/1965 | Galli |
| 3,179,396 | A | | 4/1965 | Bracken |
| 3,818,156 | A | | 6/1974 | Augustyniak |
| 3,946,186 | A | | 3/1976 | Howie, Jr. |
| 3,985,982 | A | | 10/1976 | Schneidinger |
| 4,002,925 | A | | 1/1977 | Monahan |
| 4,021,626 | A | | 5/1977 | Becker |
| 4,164,635 | A | | 8/1979 | Finch et al. |
| 4,178,491 | A | * | 12/1979 | Orscheln et al. ..... 200/34 |
| 4,488,024 | A | | 12/1984 | Colgate |
| 4,645,942 | A | | 2/1987 | Nilssen |
| 4,760,227 | A | | 7/1988 | Boxer |
| 4,835,413 | A | | 5/1989 | Nilssen |
| 4,912,376 | A | | 3/1990 | Strick |
| 5,306,957 | A | | 4/1994 | Ellingham et al. |

(Continued)

*Primary Examiner* — Renee Luebke
*Assistant Examiner* — Lheiren Mae Caroc
(74) *Attorney, Agent, or Firm* — Christensen O'Connor Johnson Kindness PLLC

(57) ABSTRACT

A switch conversion apparatus including an interface device, a mounting plate configured to mount to a toggle switch and including at least one aperture for receiving a toggle arm of a toggle switch, and an actuator plate configured to slidably engage the mounting plate and including at least one aperture for receiving and engaging a toggle arm of a toggle switch when engaged by the interface device so as to transition the state of the switch. Other embodiments of a switch conversion apparatus include one or more mechanical, electrical, and/or pneumatic timers.

2 Claims, 9 Drawing Sheets

(56) References Cited

U.S. PATENT DOCUMENTS

| | | | |
|---|---|---|---|
| 5,397,869 | A | 3/1995 | Huen |
| 5,577,602 | A | 11/1996 | Conner et al. |
| 5,719,362 | A | 2/1998 | Gray, Jr. |
| 5,806,665 | A | 9/1998 | Houssian |
| 5,828,018 | A | 10/1998 | Cooper |
| 5,955,796 | A | 9/1999 | Nilssen |
| 5,998,747 | A | 12/1999 | Kelso et al. |
| 6,426,472 | B1 | 7/2002 | Carlson |
| 6,710,274 | B2 | 3/2004 | Whetzel et al. |
| 6,861,601 | B2 | 3/2005 | Heien |
| 7,189,936 | B2 | 3/2007 | Gray, Jr. |
| 7,244,900 | B1 | 7/2007 | Gray, Jr. |
| 7,544,906 | B2 | 6/2009 | Blakeman |
| 7,977,594 | B1 * | 7/2011 | Miserendino et al. ..... 200/330 |
| 2002/0074216 | A1 | 6/2002 | Carlson |
| 2004/0168897 | A1 | 9/2004 | Heien |
| 2005/0082150 | A1 | 4/2005 | Gray, Jr. |
| 2008/0296136 | A1 | 12/2008 | Kelso et al. |

* cited by examiner

SWITCH CONVERSION APPARATUS

REFERENCE TO RELATED APPLICATIONS

This application claims the benefit of U.S. Provisional Application No. 61/251,094, filed Oct. 13, 2009, entitled "Switch Conversion with Timer Mechanism" and U.S. Provisional Application No. 61/318,997, filed Mar. 30, 2010, entitled "Rocker Switch Conversion."

TECHNICAL FIELD

The present invention relates to mechanical, mountable apparatus for easily converting a switch, such as a standard and commonly-used toggle switch for lights or fans, for example, into a rocker, bar, paddle, panel, or flat switch, for example, without removal of the existing switch assembly. The invention also relates to switch conversion apparatus with mechanical, pneumatic, and electrical timer means for selectively transitioning the switch state.

BACKGROUND OF THE INVENTION

Increasingly, consumers are choosing devices and products for the home and workplace that not only provide standard, functional operation, but are also aesthetically pleasing, environmentally conservative, socially responsible, and universally accessible. Such devices and products are generally more attractive, energy-saving, cost-reducing, environmentally-conscious, and barrier-free. Such products that meet many or all of these consumer desires are increasingly favored in the marketplace.

Though such energy-friendly and/or universally accessible, such as Americans with Disabilities Act ("ADA")-compliant, products are often objectively superior, barriers often include cost, ease of use, and simplicity of installation. For example, standard toggle switches are found in the majority of residential and commercial settings but are not ADA-compliant and suffer from the common problem of forgetting to turn off the switch thereby wasting energy and other resources.

Although lifestyle trends illustrate a growing preference for the use of rocker, flat panel, and other universally accessible switches, rather than the commonly-used toggle switch, installation is a substantial deterrent to many consumers as they lack the ability to safely, and correctly, remove an existing toggle switch and install a rocker or flat panel switch and therefore require the services of an electrician thereby increasing installation cost. Even for electricians trained in such electrical systems, the time required to replace a standard toggle switch, particularly in high volume, is a substantial deterrent to replacement and conversion.

Moreover, failure to turn off a bathroom fan or bedroom light, for example, when leaving a room is a common problem resulting in a waste of energy, shortening of the lifespan of the electrical device requiring earlier replacement, and a rise in utility costs. Timer devices, particularly those used in conjunction with a light or fan switch, provide an effective method of eliminating unnecessary energy usage. By automatically and/or selectively turning off a switch which has unintentionally been left on, energy usage is reduced and utility costs are lowered. However, energy-saving switches generally require communication with a motion-detection system, at a substantial cost to the consumer, or require replacement of an existing switch with an entire switch apparatus, including electrical components such as widely-available electrical timer-based bathroom fans, thereby suffering from the same deficiencies noted above including increased cost and inconvenience, among others.

Accordingly, there is a need in the art for an easy to install, safe, convenient, and cost-effective method and apparatus for replacing an existing switch with a universally accessible, energy efficient switch.

BRIEF DESCRIPTION OF THE DRAWINGS

The present invention is disclosed with reference to the accompanying drawings, wherein.

Figure 1:
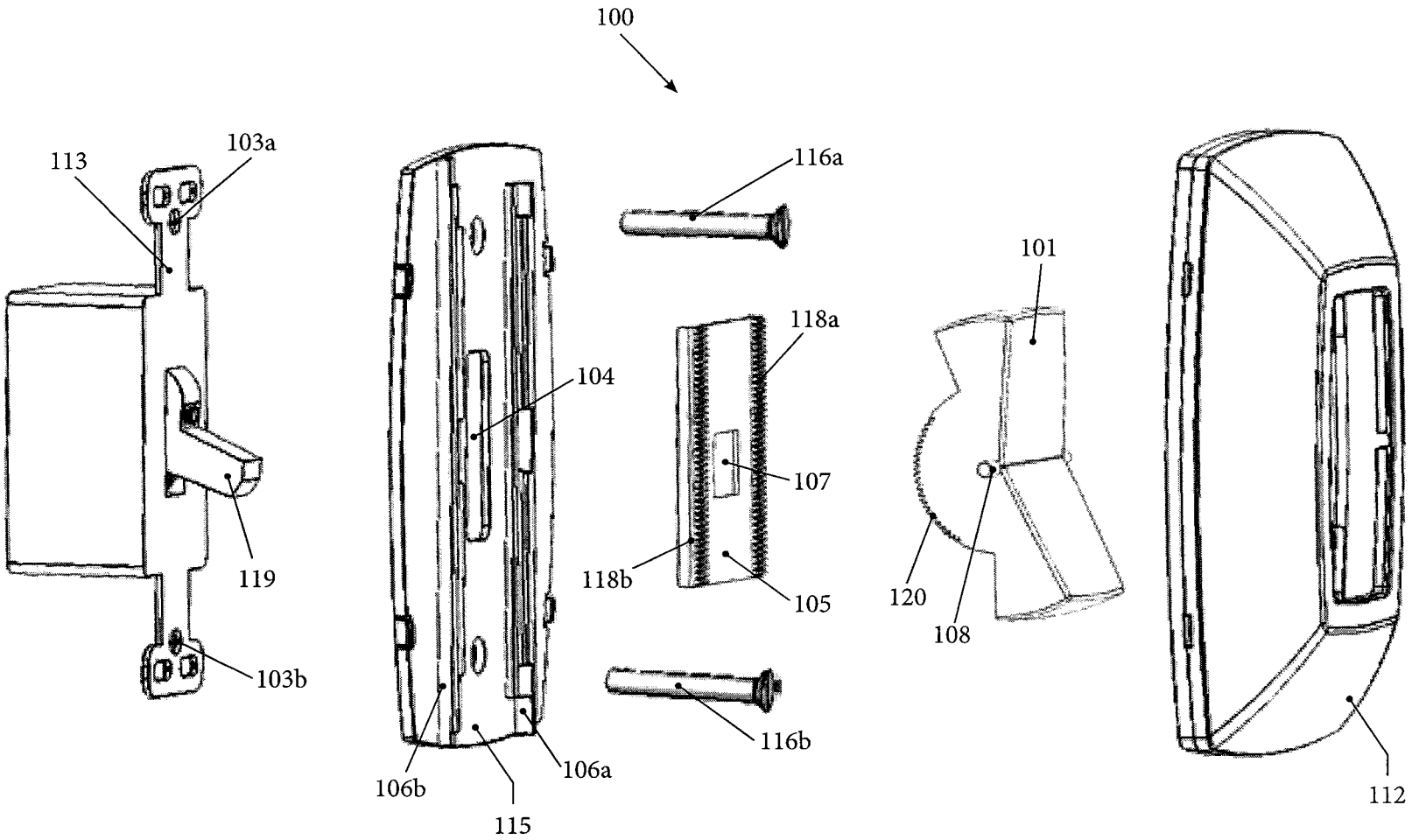
FIG. 1 is an exploded view of an exemplary toggle switch conversion apparatus according to one embodiment of the present invention.

It will be appreciated that for purposes of clarity and where deemed appropriate, reference numerals have been repeated in the figures to indicate corresponding features.

DETAILED DESCRIPTION

Referring to FIG. 1, an exploded view of one embodiment of a switch conversion apparatus 100 for converting a toggle switch 113 is shown as including a mounting plate 115, an actuator plate 105, a paddle 101, and a cover 112. The mounting plate 115 is configured to attach to a standard toggle switch 113 such as at holes 103 such as by screws 116, or any other means of attachment, and so as to receive a toggle arm 119 at an aperture 104. The actuator plate 105 is configured to slidably engage the mounting plate 115 at one or more channels 106 and is further configured to receive and engage toggle arm 119 through aperture 107. The actuator plate 105 further includes a plurality of rack gear teeth 118 as shown in the exemplary embodiment of FIG. 1 as two sets of rack gear teeth 118*a*, 118*b* disposed on opposing sides of actuator plate 105. However, any number of rack gear teeth 118 can be disposed on any portion of the surface of actuator plate 105. The paddle 101 includes at least one curved surface including a plurality of sector gear teeth 120 configured to engage one or more of the rack gear teeth 118 of the actuator plate 105 when rotated about pivot point 108. The paddle 101 can be a panel, flat, and/or rocker, for example. The paddle 101 further includes a cavity (not shown) adjacent the at least one curved surface 120 and configured to receive the toggle arm 119. The paddle 101 is configured to rotatably engage the cover 112 at pivot point 108. The cover 112 is configured to attach to mounting plate 115 such as by snapping, clipping, adhesive, screw(s), magnet(s), or any other means of attachment.

In operation, upon user interaction with the paddle 101, the paddle 101 rotatably engaged the cover 112 so as to rotate about pivot point 108 thereby engaging sector gear teeth 120 and rack gear teeth 118 so as to convert the rotational motion of the paddle 101 into translational motion of the actuator plate 105 along channel(s) 106 in mounting plate 115. As actuator plate 105 moves, aperture 107 engages toggle arm 119 thereby transitioning the state of the switch 113. Accordingly, the exemplary toggle switch conversion apparatus is a simple, easy to install, low cost, non-electrical apparatus for converting a reduced-accessibility toggle switch into a universally accessible and compliant paddle, rocker, flat, or panel switch, for example.

Figure 2:
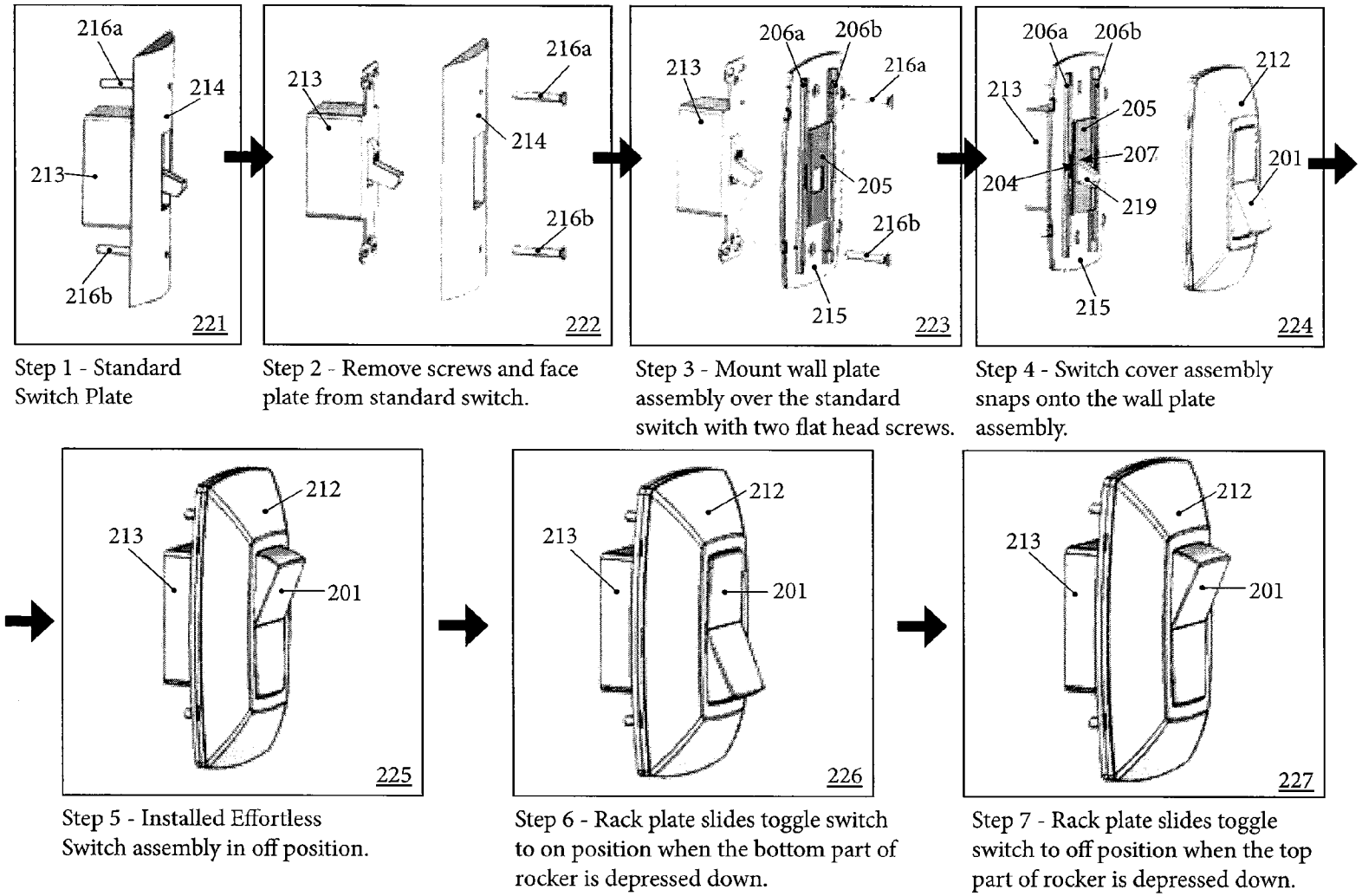
FIG. 2 is a flow diagram of exemplary operation of a toggle switch conversion apparatus according to one embodiment of the present invention.

Referring to FIG. 2, a flow diagram of exemplary operation of installation and use of a toggle switch conversion apparatus according to one embodiment of the present invention is shown. In the first step 221, a standard toggle switch 213, face plate 214, and attachment screws 216 are shown as exemplary of an existing toggle switch and face plate as could be mounted to a wall (not shown), for example. In the second step 222, the face plate 214 is removed at screws 216. In the third step 223, a mounting plate 215 is attached to toggle switch 213 such as by screws 216. Slidably engaging mounting plate 215 at one or more channels 206 is an actuator plate 205. In the fourth step 224, the mounting plate 215 and actuator plate 205 are disposed such that toggle arm 219 extends through aperture 204 in the mounting plate 215 and aperture 207 in the actuator plate 205. A cover 212 and paddle 201 are attached to mounting plate 215 such as by a snap fit of the cover 212 to a perimeter portion of the mounting plate 215, for example. In steps 5, 225, 6, 226, and 7, 227, the paddle 201 is pressed at a top portion and at a bottom portion, respectively, so as to transition the state of the switch 213 from off to on and off again, respectively, as shown.

Figure 3:
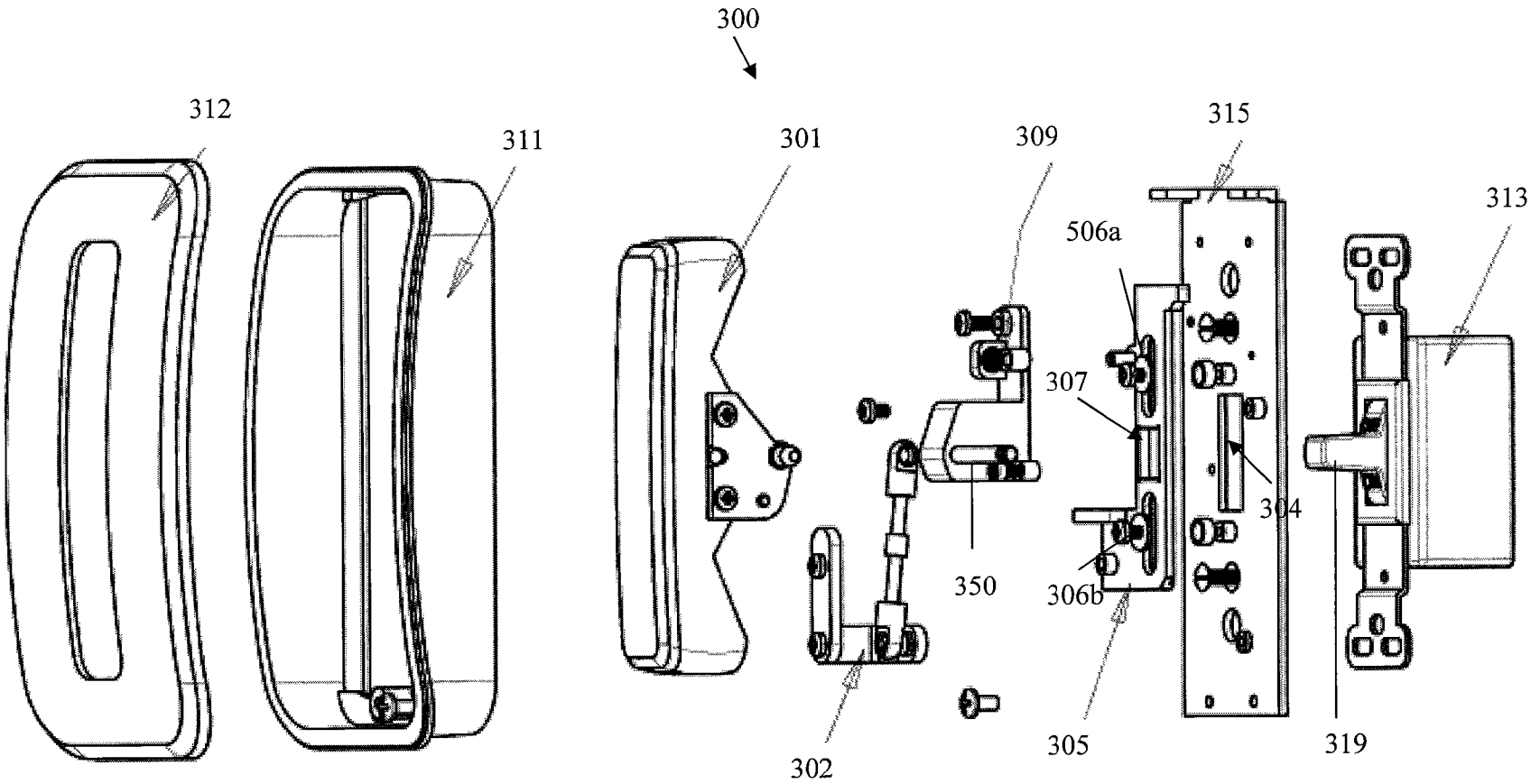
FIG. 3 is an exploded view of an exemplary toggle switch conversion apparatus according to one embodiment of the present invention.

Referring to FIG. 3, an exemplary toggle switch conversion apparatus 300 according to one embodiment of the present invention is shown as including a mounting plate 315 configured to slidably engage an actuator plate 305 at one or more actuator plate 305 slots 306. The mounting plate 315 further includes an aperture 304 for receiving a toggle arm 319 and the actuator plate 305 includes an aperture 307 for receiving and engaging the toggle arm 319. Switch bar 301 is configured to engage linkage 302 upon user interaction with the switch bar 301. The linkage 302 is configured to engage the actuator plate 305 such as at shaft 350, for example, and, upon translational movement of actuator plate 305, over-center spring 309 is expanded and toggle arm 319 is engaged by actuator plate 305 at aperture 307 thereby transitioning switch 313. In order to transition the state of the switch 313, the user can engage the switch bar 301 to engage linkage 302 thereby moving the actuator plate 305 by compression of over-center spring 309.

Figure 4:
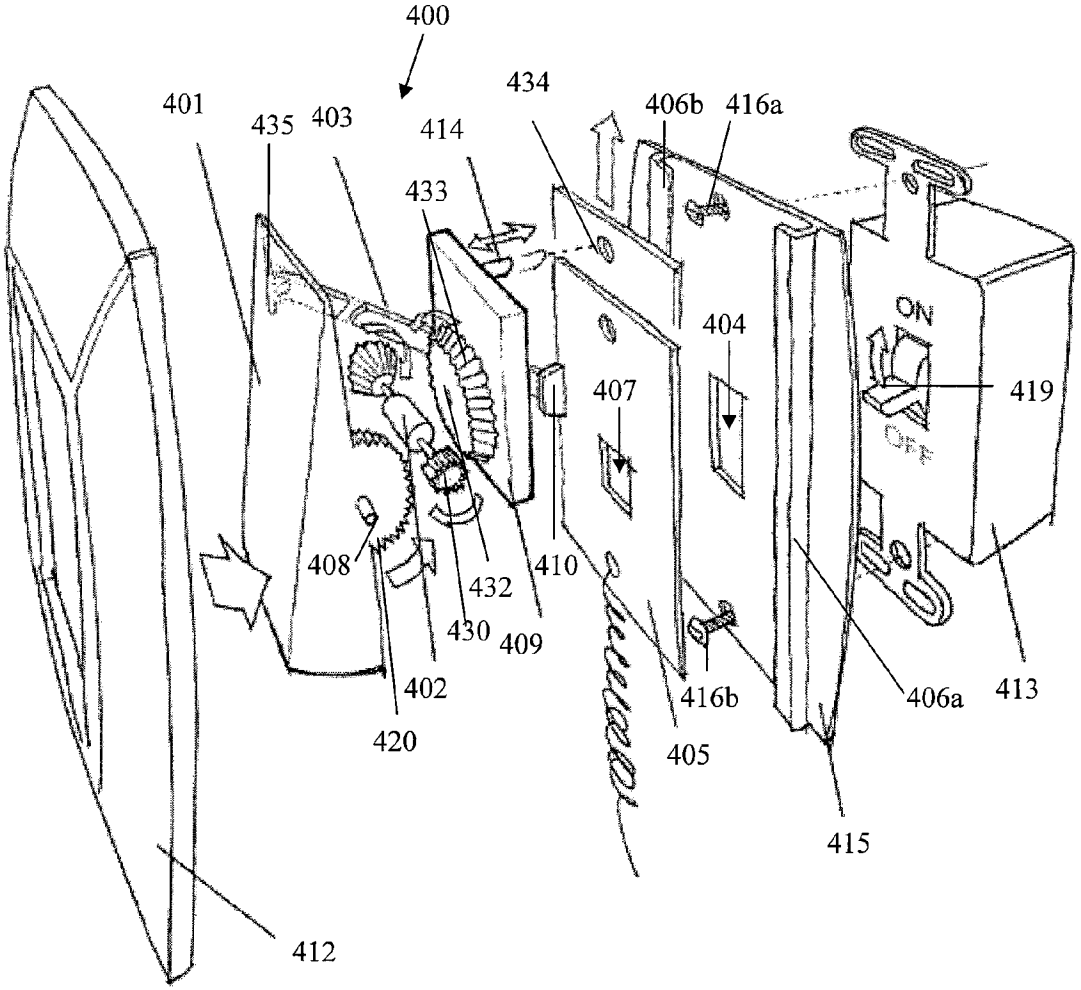
FIG. 4 is an exploded view of an exemplary toggle switch conversion apparatus with mechanical timer according to one embodiment of the present invention.

Referring to FIG. 4, an exemplary toggle switch conversion apparatus 400 according to one embodiment of the present invention is shown as including a mechanical timer 409 and associated mechanism as described in detail below. Switch conversion apparatus 400 includes a mounting plate 415 configured to mount to a standard toggle switch 413 such as by screws 416 wherein the mounting plate 415 includes at least one channel 406 configured to slidably engage an actuator plate 405. Mounting plate 415 further includes an aperture 404 for receiving toggle arm 419 and actuator plate 405 further includes an aperture 407 for receiving and engaging toggle arm 419. A lever 403 is configured to engage actuator plate 405 at a pivot 410 and is further configured to communicate with paddle 401 at hinge 435 such that user interaction with paddle 401 causes lever 403 to rotate about pivot 410 thereby converting the rotational motion of the lever 303 into translational motion of the actuator plate 405 along one or more channels 406 of the mounting plate 415.

The paddle 401 of switch conversion apparatus 400 further includes a curved surface including a plurality of sector gear teeth 420 configured to engage a gear assembly 402 at one or more gears 430. The gear assembly 402 further includes a one-way clutch. The one or more gear(s) 430 is configured to engage mechanical timer 409, such as a spring-based wind timer as is known in the art, at a gear 432 having a plurality of teeth 433. A latch pin 414 is disposed adjacent the timer 409 and the latch pin 414 can include a spring for biasing the pin against actuator plate 405 and specifically configured to engage actuator plate 405 at aperture 434 upon alignment of the latch pin 414 and the aperture 434.

Accordingly, in one exemplary operation of switch conversion apparatus 400, upon user interaction with paddle 401, the paddle 401 rotatably engages cover 412 thereby rotating about pivot 408 and thereby communicating with lever 403 at hinge 435 to rotatably engage actuator plate 405 at pivot 410 thereby causing the actuator plate 405 to move along one or more channels 406 of mounting plate 415 such that latch pin 414 engages the actuator plate 405 at aperture 434. Moreover, rotation of the paddle 401 about pivot 408 causes sector gear teeth 420 to rotatably engage one or more gears 430 of the gear assembly 402 which then rotatably engages gear teeth 433 of gear 432 of the timer 409 thereby winding the timer 409. Due to the one-way clutch of the gear assembly 402, successive user interaction with the paddle 401 will continue to wind the timer 409 in the same manner as lever 403 will rotate about hinge 435 and pivot 410 but will not move actuator plate 405 due to engagement of the latch pin 414 with the actuator plate 405 at aperture 434. Accordingly, the user can determine the amount of time the switch 413 will be in one state, generally an "on" state, based on a multiplier of the manufacturer's predetermined timer 409 wind interval. Upon expiration of timer 409, the timer 409 is configured to bias latch pin 414 away from aperture 434, such as by compression of a spring (not shown) attached to latch pin 414, resulting in translational motion of the actuator plate 405 along one or more channels 406 in mounting plate 415 and engagement with toggle arm 419 thereby transitioning the state of switch 413.

Figure 5:
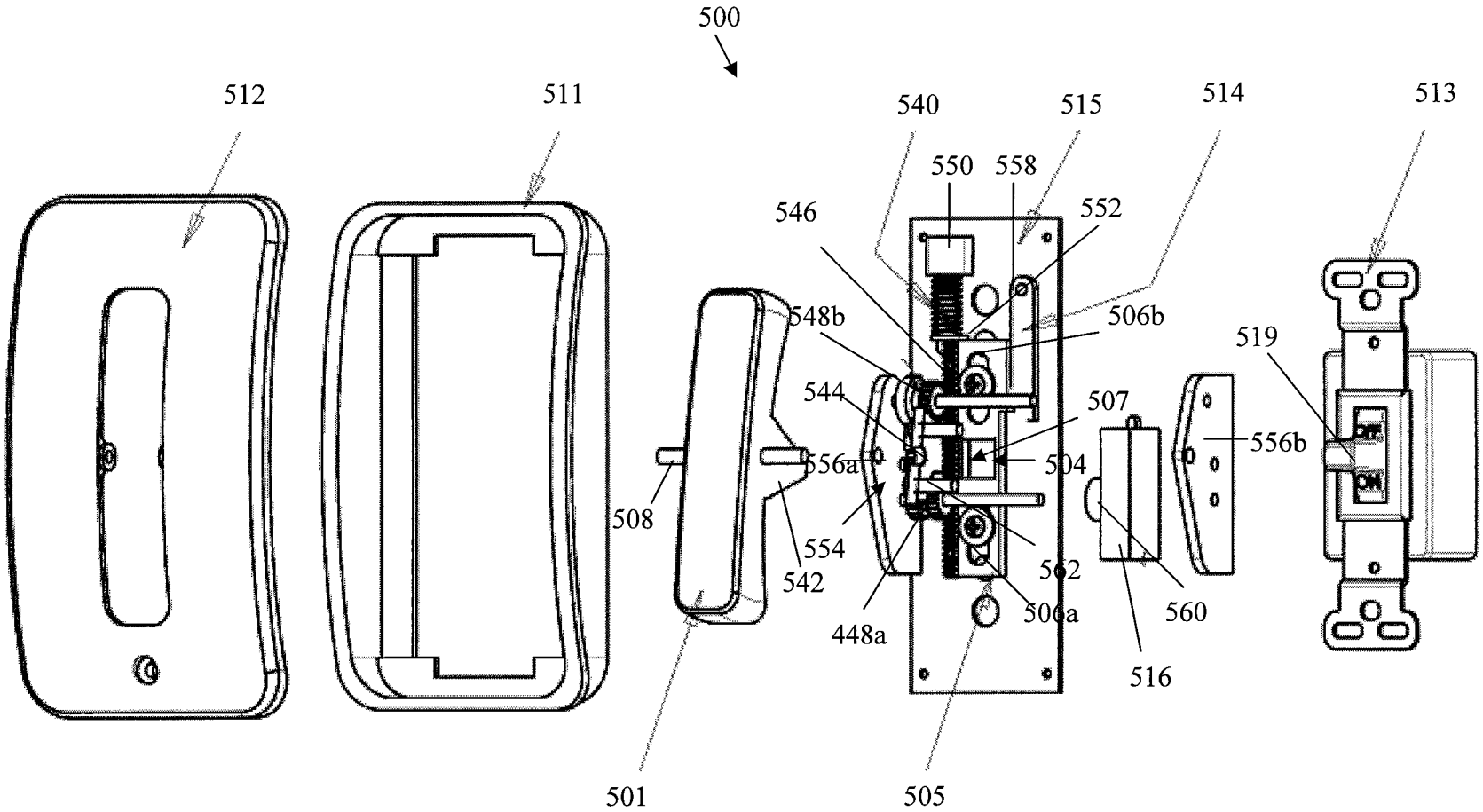
FIG. 5 is an exploded view of an exemplary toggle switch conversion apparatus with mechanical timer according to one embodiment of the present invention.

Referring to FIG. 5, an exemplary toggle switch conversion apparatus 500 according to one embodiment of the present invention is shown as including a mounting plate 515 configured to mount to a toggle switch 513 and including at least one channel 506 for slidably mounting an actuator plate 505. The mounting plate 515 further includes an aperture 504 for receiving a toggle arm 519 and the actuator plate 505 includes an aperture 507 for receiving and engaging a toggle arm 519 of the toggle switch 513. Disposed proximate the mounting plate 515 is a gear assembly 554 including one or more gears 544, 548 configured to engage a gear train 546 slidably attached to mounting plate 515. The gear assembly 554 is optionally attached by one or more side plates 556 attached to mounting plate 515 and optionally includes spindles, rods, and/or cylinders configured to mount one or more gears 548. The switch conversion apparatus 500 further includes a switch bar 501 including pivot 508 and at least one extension portion 542, shown in FIG. 5 as angular in shape, configured to engage gear 544 such as at one or more shafts 562, wherein the gear 544 can engage the gear train 546 directly or, alternatively, indirectly by engaging gear(s) 548. Disposed proximate one end of the gear train 546 is a spring 540 and disposed proximate the spring 540 at a first end is a stationary retainer 550 attached to the mounting plate 515 and configured to cause compression of the spring 540 when the spring 540 is engaged by the gear train 548, and/or the actuator plate 505, at a second end of the spring 540. In one embodiment, the gear train 546 is attached to the actuator plate 505. In another embodiment, the actuator plate 505 is retained in channels 506 by spring 550 and moves in one or more channels 506 upon compression of the spring 540 by the gear train 546. Upon translational motion of the actuator plate 505 in channels 506, a latch 514, attached to the mounting plate 515 at a pivot 558 and so as to be biased toward the actuator plate 505, is configured to engage the actuator plate 505 thereby substantially maintaining its position and, thereby, compression of the spring 550.

The switch conversion apparatus 500 further includes a mechanical timer 516 including a gear 560 configured to engage at least one of the gear train 546 or one or more gears 548 of the gear assembly 554 so as to wind the timer 516 as is known in the art. Upon expiration, the timer 516 is configured to engage the latch 558 so as to release the actuator plate 505 thereby decompressing the spring 540, engaging toggle arm 519 at aperture 507 so as to transition switch 513, and reversing the prior rotation of at least gear 544 thereby rotating switch bar 501 about pivot 508. The switch conversion apparatus 500 further includes a cover housing 511 configured to mount to the mounting plate 515 and a cover 512 configured to mount to the cover housing 511 wherein switch bar 501 is configured to rotatably engage, at pivot 508, at least one of the housing 511 and the cover 512.

Accordingly, in one exemplary operation of switch conversion apparatus 500, upon user interaction with switch bar 501, the switch bar 501 rotatably engages cover 512 at pivot 508 thereby engaging gear assembly 554 at one or more shafts 562 of gear 544 causing rotational motion of gear 544 which is converted to translational motion of gear train 546. Upon engagement by gear 544, the gear train rotatably engages gear 560 of timer 516 so as to wind timer 516 and the gear train 544 further engages the spring 540 thereby causing the spring 540 to compress. As spring 540 compresses, actuator plate 505 moves in channels 506 in mounting plate 515 at least until it comes to a rest state as maintained by latch 514. As actuator plate 505 moves, toggle arm 519 is engaged by aperture 507 thereby transitioning switch 513. Upon expiration of the timer 516, the timer 516 rotatably biases the latch 514 about pivot 558 thereby releasing the actuator plate 505 which is then moved in channels 506 of mounting plate 515 due to decompression of spring 540. As actuator plate 505 moves in channels 506 of mounting plate 515, the toggle arm 519 is engaged by aperture 507 in the actuator plate 505 thereby transitioning switch 513. Further, the timer 516 can be manually overridden by user engagement with the switch bar 501 thereby disengaging latch 514. Upon disengagement of latch 514, the return spring 540 engaged actuator plate 505 which engages toggle arm 519 thereby transitioning the state of switch 513.

Figure 6:
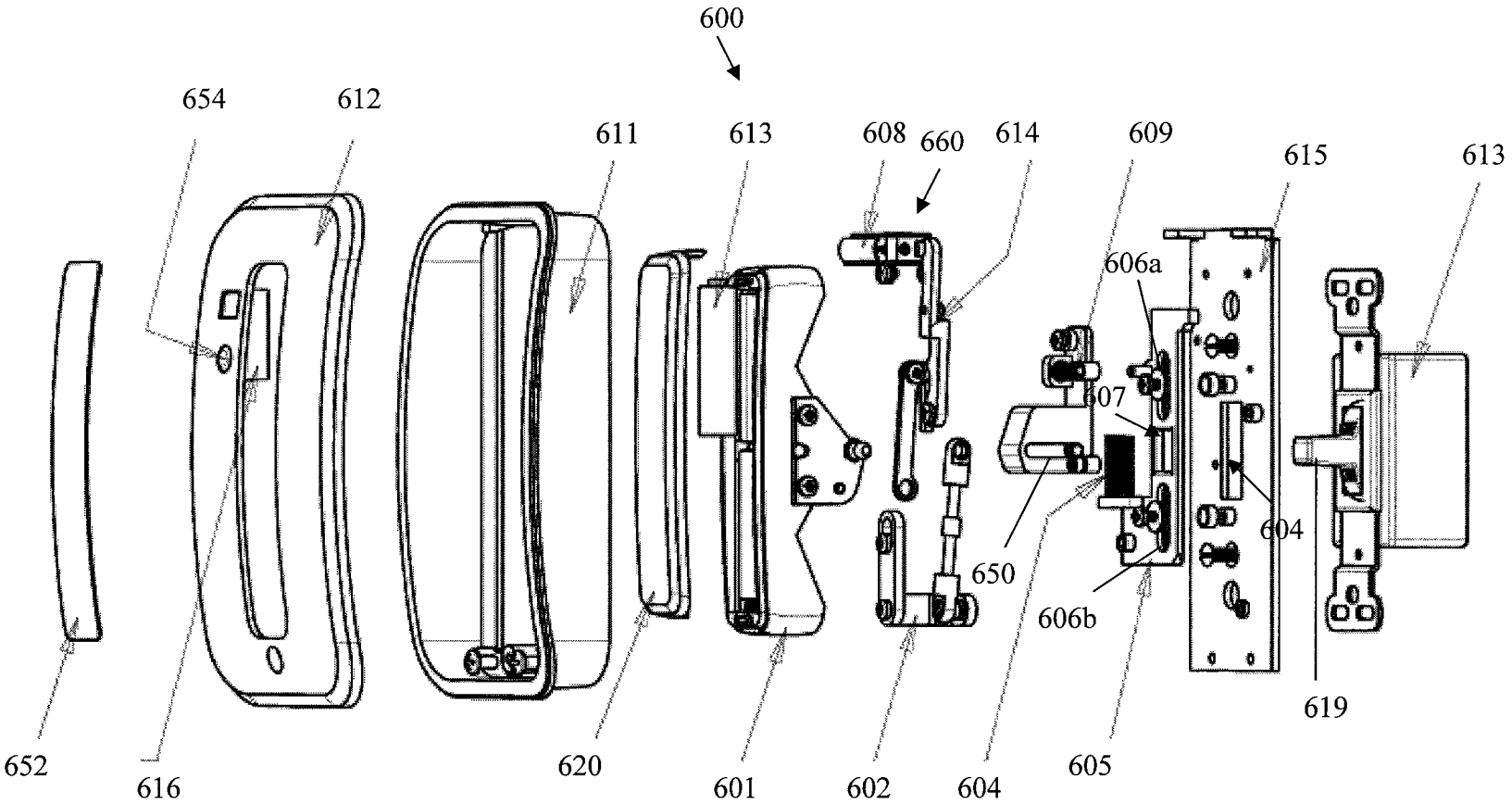
FIG. 6 is an exploded view of an exemplary toggle switch conversion apparatus with electrical timer according to one embodiment of the present invention.

Referring to FIG. 6, an exemplary toggle switch conversion apparatus 600 according to one embodiment of the present invention is shown as including a mounting plate 615 configured to slidably engage an actuator plate 605 at one or more channels 606. The mounting plate 615 further includes an aperture 604 for receiving a toggle arm 619 and the actuator plate 605 includes an aperture 607 for receiving and engaging the toggle arm 619. Switch bar 601 is configured to engage linkage 602 upon user interaction with the switch bar 601. The linkage 602 is configured to engage the actuator plate 605 such as at shaft 650, for example, and, upon translational movement of actuator plate 605, over-center spring 609 is expanded, return spring 604 is compressed, and toggle arm 619 is engaged by actuator plate 605 at aperture 607 thereby transitioning switch 613. Further, upon translational movement of actuator plate 605, a latch 614 is configured to engage the actuator plate 605 so as to maintain the position of the actuator plate 605 toward one end of the one or more channels 606.

In the exemplary embodiment shown in FIG. 6, the switch conversion apparatus 600 includes an electronic timer 616 and timer interface 654 for selectively setting the timer 616 interval. Timer interface 654 can be one or more buttons, a keypad, a touchscreen or any other user interface configured to communicate a time interval to the timer 616. The timer 616 is optionally mounted to a cover 612. A power supply 613, such as a conventional or rechargeable battery, is disposed proximate the timer 616 and configured to electrically communicate with the timer 616. The power supply is optionally covered by power supply cover 620 configured to engage switch bar 601. Upon expiration, the timer 616 is further configured to energize a release actuator 608 attached to release linkage 660 and configured to engage the latch 614 thereby disengaging latch 614 from actuator plate 605 so as to release actuator plate 605 and compress over-center spring 609 thereby biasing the actuator plate in the one or more channels 606 thereby engaging toggle arm 619 at aperture 607 and transitioning switch 613. A housing 611 is configured to attach to mounting plate 615 and engage cover 612 thereby substantially maintaining the position of at least switch bar 601. Optionally, a photovoltaic panel 652 is disposed on the exterior portion of cover 612 wherein the photovoltaic panel 652 is configured to communicate with and recharge the power supply 613. Further, the timer 616 can be manually overridden by user engagement with the switch bar 601.

Figure 7:
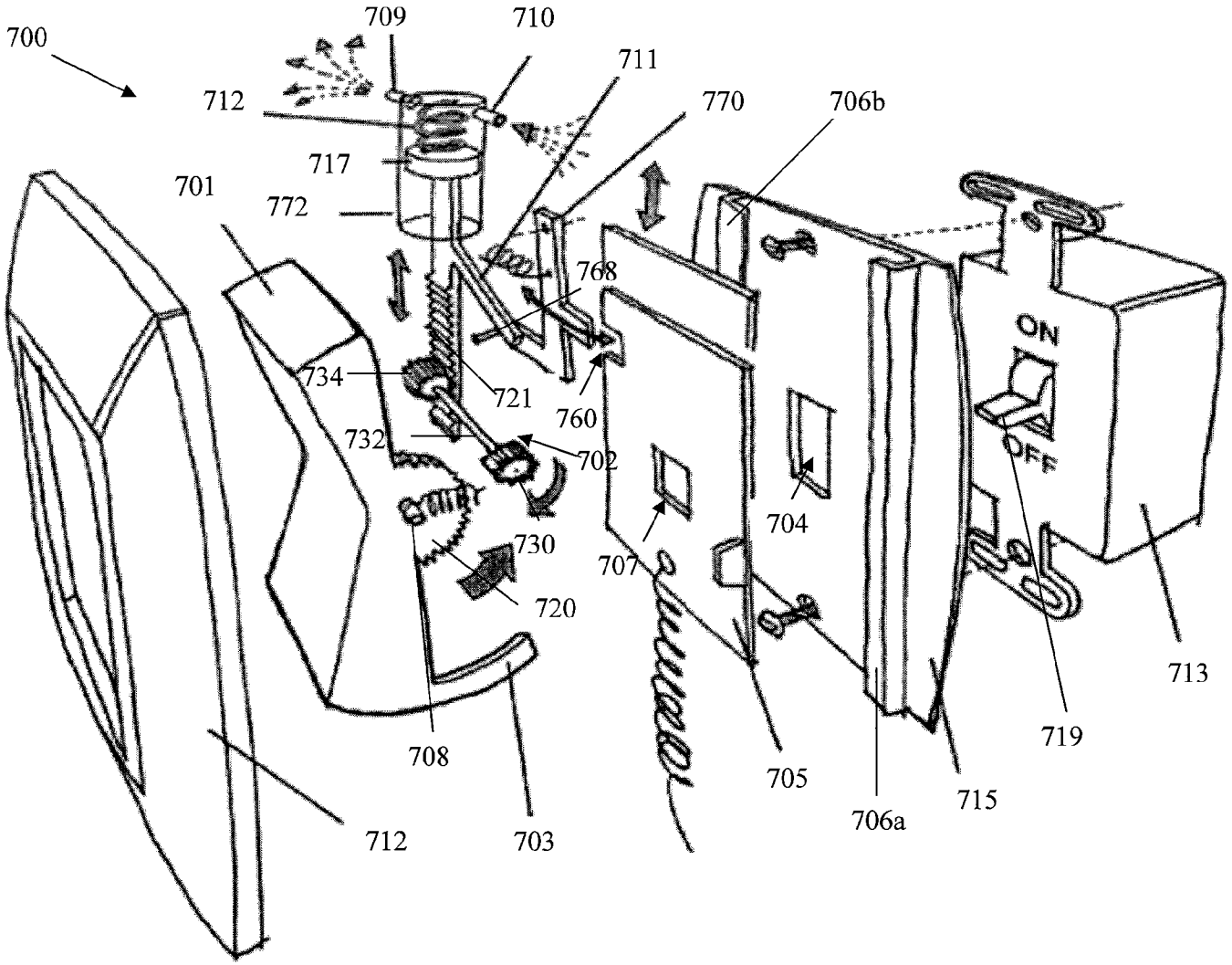
FIG. 7 is an exploded view of an exemplary toggle switch conversion apparatus with pneumatic timer according to one embodiment of the present invention.

Referring to FIG. 7, an exemplary toggle switch conversion apparatus 700 according to one embodiment of the present invention is shown as including a mounting plate 715 configured to slidably engage an actuator plate 705 at one or more channels 706. The mounting plate 715 further includes an aperture 704 for receiving a toggle arm 719 and the actuator plate 705 includes an aperture 707 for receiving and engaging the toggle arm 719. Switch conversion apparatus 700 further includes a paddle 701 having a curved surface including a plurality of sector gear teeth 720 and a lever 703. The plurality of sector gear teeth 720 are configured to engage gear assembly 702 at one or more gears 730 disposed at a first end of the gear assembly 702 thereby rotating rod 732 of the gear assembly 702 which is attached to at least one gear 734 at a second end of the gear assembly 702. The gear 734 is configured to engage a gear train 721 attached to a piston 717 disposed inside cylinder 772. Disposed toward a top portion of the cylinder 717 is a check valve 709 and an orifice valve 710. Disposed proximate the piston 717 and the cylinder is a spring 712. Attached to one end of the gear train 721 is an arm 711 attached to a pawl 770 at a pivot 768 wherein the pawl 770 is configured to be biased toward and engage the actuator plate such as at a recessed portion 760. Paddle 701 is configured to rotatably engaged cover 712 and cover 712 is configured to attach to mounting plate 715, for example.

Accordingly, in one exemplary operation of switch conversion apparatus 700, upon user interaction with the paddle 701, the paddle 701 rotatably engages the cover 712 at pivot 708 thereby engaging actuator plate 705 with lever 703 such that actuator plate 705 moves in channels 706 of mounting plate 715 so as to latch with biased pawl 770 such as at recessed portion 760. Upon movement of actuator plate 705 in channels 706 of mounting plate 715, toggle arm 719 is engaged by actuator plate 705 at aperture 707 thereby transitioning switch 713.

Further, the rotational motion of paddle 701 causes sector gear teeth 720 to engage gear 730 which rotates gear 734 by rod 732. Gear 734 then converts the rotational motion into translational motion of piston 717 by engaging gear train 721 attached to piston 717. Piston 717 then compresses spring 712 in cylinder 772 forcing air to exit check valve 709. As orifice valve 710 gradually receives air into the cylinder, spring 712 gradually expands thereby moving piston 717 and attached arm 711 until pawl 772 rotates about pivot 768 thereby releasing actuator plate 705 which moves along channels 706 in mounting plate 715 thereby engaging toggle arm 719 at aperture 707 and transitioning switch 713.

The time interval between transitions of switch 713 is at least partially dependent on the spring constant of spring 712 and therefore can be increased or decreased by selecting a spring 712 with lower or higher spring constant, respectively. The time interval between transitions of switch 713 can be further modified based on the size of check valve 709 and/or orifice valve 710 such that a larger check valve 709 and/or orifice valve 710 will decrease the time interval and a smaller check valve 709 and/or orifice valve 710 will increase the time interval. Further, the time interval between transitions of switch 713 can also be increased or decreased by modifying one or more cylinder dimensions such as length and width/diameter/circumference, for example. The switch conversion apparatus 700 as shown in FIG. 7 is further configured such that successive user interaction with paddle 701, while actuator plate 705 is latched by pawl 770, will further compress spring 712 thereby resetting the time interval and/or adding additional time before release of the actuator plate 705 and subsequent transition of switch 713.

Figure 8:
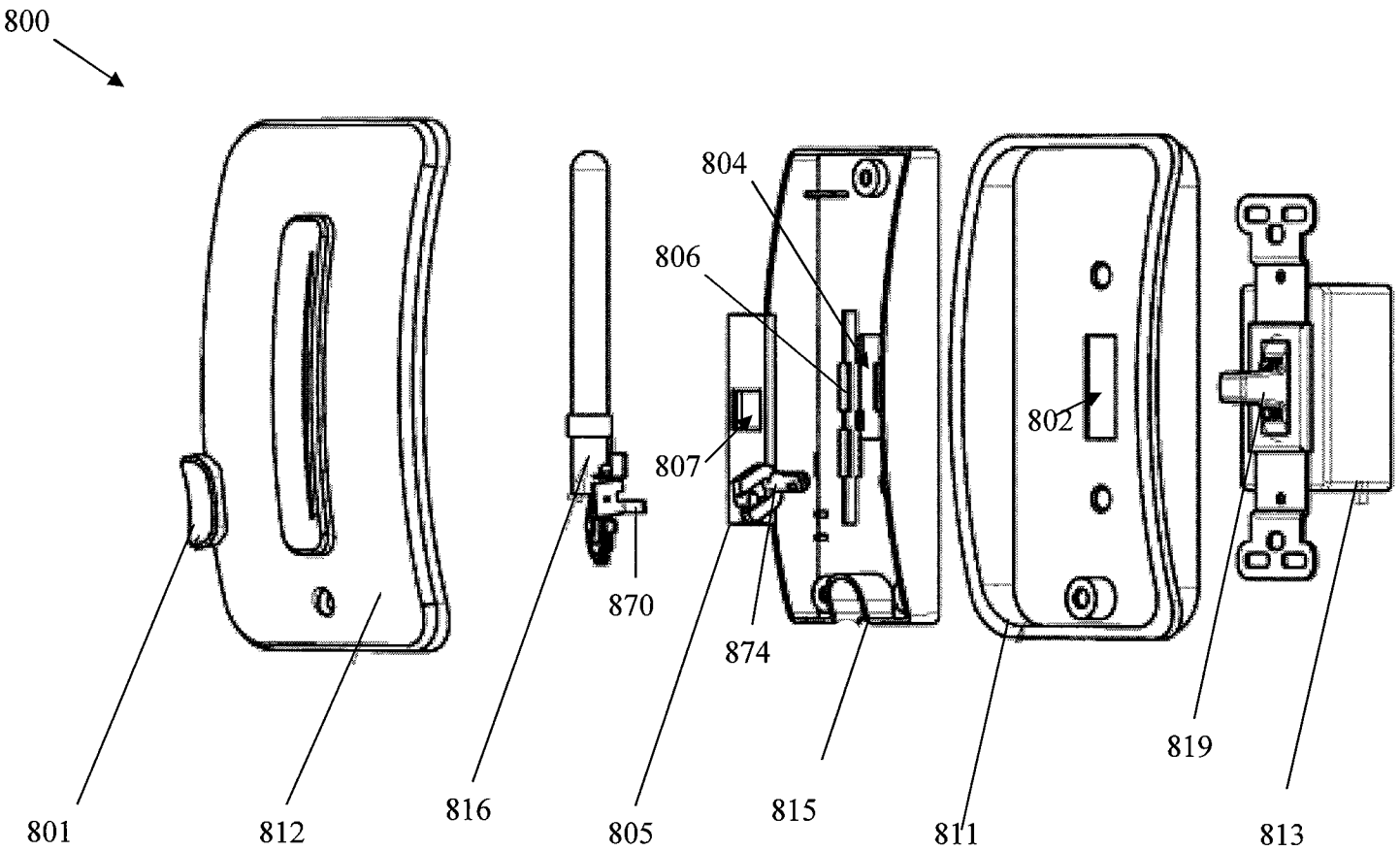
FIG. 8 is an exploded view of an exemplary toggle switch conversion apparatus with pneumatic timer according to one embodiment of the present invention.

Referring to FIG. 8, an exemplary toggle switch conversion apparatus 800 according to one embodiment of the present invention is shown as including a housing 811, configured to attach to a toggle switch 813, a mounting plate 815, and an actuator plate 805 configured to slidably engage the mounting plate 815 such as at one or more channels or channels 806, for example. Each of the housing 811, mounting plate 815, and actuator plate 805 includes an aperture, 802, 804, 807, respectively, configured to receive toggle arm 819 wherein the aperture 807 is further configured to engage toggle arm 819 in operation. Switch conversion apparatus 800 further includes a pneumatic timer 816 including a cylinder, piston, one or more valves, and timer interface 870. User interaction with slider 801 so as to move slider 801 vertically, as in the example switch conversion apparatus 800 shown, engages timer interface 870 so as to cause corresponding translational movement thereby displacing a piston (not shown) as well as engaging yoke 874, attached to actuator plate 805, so as to cause corresponding translational movement of actuator plate 805 along one or more channels 806 in mounting plate 815 thereby engaging toggle arm 819 so as to transition switch 813. Timer interface 870 is configured to reverse its translational movement as air is received through orifice valve (not shown) in cylinder of timer 816 thereby displaying piston (not shown) and timer interface 870 which, when moved, causes a corresponding translational movement of yoke 874 thereby reversing the translational motion of the actuator plate 805 in channel 806 of mounting plate 815 wherein the actuator plate 805 engages toggle arm 819 at aperture 807 thereby transitioning switch 813. The timer 816 interval is selectable based on travel distance of slider 801, and corresponding travel of time interface 870 and piston (not shown), as well as timer 816 valve (not shown) size, and cylinder 816 dimensions, among other means of selection. The switch conversion apparatus 800 further includes a cover 812 which is configured to engage at least one of mounting plate 815 and housing 811 wherein slider 801 is configured to slidably engage the cover 812.

Figure 9:
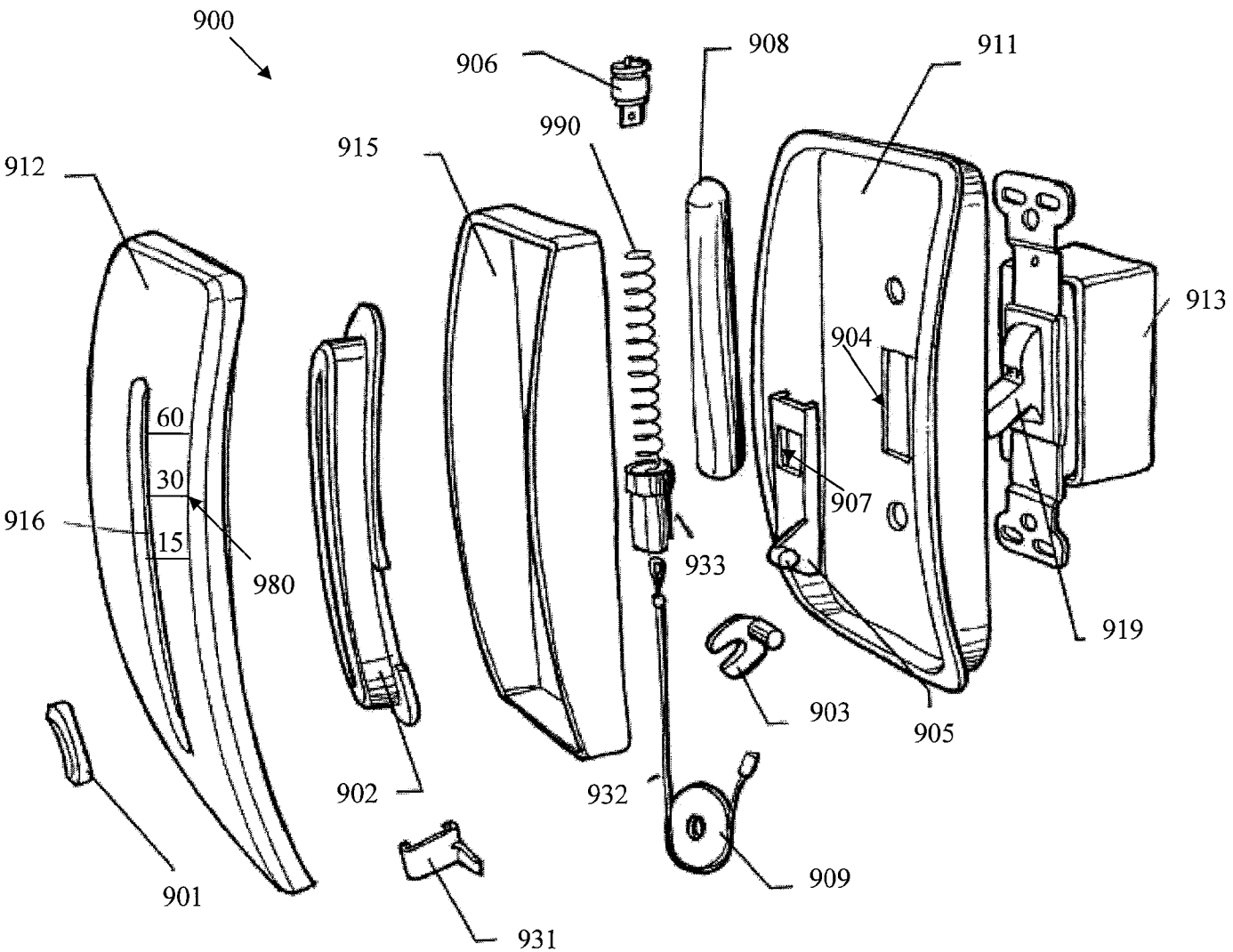
FIG. 9 is an exploded view of an exemplary toggle switch conversion apparatus with pneumatic timer according to one embodiment of the present invention.

Referring to FIG. 9, an exemplary toggle switch conversion apparatus 900 according to one embodiment of the present invention is shown as including at least one housing and/or mounting plate 911, 915 configured to attach to a toggle switch 913, and an actuator plate 905. The housing 911 further includes an aperture 904 for receiving a toggle arm 919 and the actuator plate 905 includes an aperture 907 for receiving and engaging the toggle arm 919. Switch conversion apparatus 900 further includes a slider 901, mounted to slide base 902 and configured to extend through channel 916 in cover 912, and a link 931 configured to slidably engage the slide base 902 and attach to the slider 901. At least a portion of the link 931 is configured to engage a yoke 903 attached to actuator plate 905 thereby causing a translational movement of the actuator plate 905 corresponding to that of the slider 901 such that actuator plate 905 engages toggle arm 919 at aperture 907 thereby transitioning the state of the switch 913. Further, a cable 932 attached to pulley 909 is configured to attached at a first end to one of link 931, yoke 903 and/or actuator plate 905 and at a second end to a piston 906 by extending through a retainer 933 in a cylinder 909. The cylinder 908 includes at least one valve (not shown). Disposed inside the cylinder and between retainer 933 and piston 906 is a spring 907. Accordingly, upon movement of at least one of the slider 901, link 931, yoke 903, and retainer plate 905, the cable 932 of pulley 909 moves piston 906 in cylinder 908 thereby compressing spring 990. As air exits the one or more valves (not shown) of the cylinder 908, the spring 990 decompresses and the piston 906 moves thereby pulling cable 932 of pulley 909 so as to move at least one of slider 901, link 931, yoke 903, and actuator plate 905 such that aperture 907 of actuator plate 905 engages toggle arm 919 thereby transitioning the state of the switch 913. Optionally disposed on at least one of slider 901, rocker arm 902, and cover 912 is one or more markings indicating the timer interval based on the distance traveled by the slider and corresponding distance traveled by the piston 906, among other apparatus components. The time interval between transitions of switch 913 is selectable based on at least one of the spring constant of spring 990, the size of the valves (not shown) of cylinder 908, one or more cylinder dimensions, and tensile strength of cable 932, among other means of selection. The switch 913 state can be transitioned manually by user interaction with the slider accelerating the decompression of the spring 990, movement of the piston 906, and translational movement of the actuator plate 905.

The above-described exemplary embodiments allow for a simple, cost-effective method of converting a switch to a universally acceptable switch without requiring interaction with the electrical system connected to the existing switch. Further embodiments are disclosed that provide energy-efficient switch conversion apparatus wherein installation is also possible without interaction with the electrical system connected to the existing switch. While several embodiments are described above with respect to the apparatus components, any arrangement of mounting brackets, mounting plates, wall plates, covers, and housings can be configured to retain the apparatus components. Further, all switch conversion apparatus described herein can be installed in a gang switch or cluster arrangement of a plurality of switches whether one or more switches are converted or of the existing/traditional type.

While the principles of the invention have been described herein, it is to be understood by those skilled in the art that this description is made only by way of example and not as a limitation as to the scope of the invention. For example, although the traditional/standard toggle switch was used in the exemplary embodiments shown in FIGS. 1-9, the converted switch can be a rocker, panel, bar, or paddle, for example. Where a rocker switch is converted to a rocker switch with timer, the new rocker interface device can be configured to engage the pre-installed rocker interface device when pressed at a top and bottom portion such as by direct engagement or communication with a pivotably attached actuator plate. The new rocker can also initiate a timer mechanism, such as those described herein, so as to rotate the new rocker interface device, or other associated actuator plate, thereby engaging the pre-installed rocker switch to transition its state. Other embodiments including permutations of interface devices, converted switches, and timer devices are contemplated. Modifications and substitutions by one of ordinary skill in the art are considered to be within the scope of the present invention, which is not to be limited except by the following claims.

What is claimed is:

1. A switch conversion apparatus, comprising:

an interface device;

a mounting plate configured to mount to a toggle switch and including at least one aperture for receiving a toggle arm of a toggle switch; and an actuator plate configured to slidably engage the mounting plate and including at least one aperture for receiving and engaging a toggle arm of a toggle switch when engaged by the interface device so as to transition the state of the switch;

a pneumatic timer including a cylinder, a piston, at least one valve, and a timer interface configured to communicate with the piston;

a yoke attached to the actuator plate;

wherein the interface device is a slider and is further configured to engage the timer interface so as to displace the piston and the yoke so as to displace the actuator plate.

2. A switch conversion apparatus, comprising:

an interface device;

a mounting plate configured to mount to a toggle switch and including at least one aperture for receiving a toggle arm of a toggle switch; and an actuator plate configured to slidably engage the mounting plate and including at least one aperture for receiving and engaging a toggle arm of a toggle switch when engaged by the interface device so as to transition the state of the switch;

a link configured to communicate with the interface device;

a yoke configured to communicate with the link and the actuator plate;

a pulley including a cable having a first end and a second end wherein the cable is attached at the first end to at least one of the slider, yoke, link, and actuator plate;

a cylinder including a first end and a second end and further including at least one valve disposed toward the first end;

a piston disposed in the cylinder and configured to attach to the second end of the cable;

a spring retainer disposed at the second end of the cylinder; and a spring disposed in the cylinder and between the piston and the spring retainer.

* * * * *